US010968069B2

(12) United States Patent
Schuler

(10) Patent No.: US 10,968,069 B2
(45) **Date of Patent: *Apr. 6, 2021**

(54) TUBE HOLDER FOR LINE DISPENSING

(71) Applicant: Aladdin Manufacturing Corporation, Calhoun, GA (US)

(72) Inventor: John T. Schuler, Calhoun, GA (US)

(73) Assignee: Aladdin Manufacturing Corporation, Calhoun, GA (US)

( * ) Notice: Subject to any disclaimer, the term of this patent is extended or adjusted under 35 U.S.C. 154(b) by 536 days.

This patent is subject to a terminal disclaimer.

(21) Appl. No.: 15/895,764

(22) Filed: Feb. 13, 2018

(65) Prior Publication Data

US 2019/0248619 A1 Aug. 15, 2019

(51) Int. Cl.
*B65H 49/06* (2006.01)
*B65H 49/16* (2006.01)
(Continued)

(52) U.S. Cl.
CPC ..... *B65H 49/06* (2013.01); *B65H 49/02* (2013.01); *B65H 49/04* (2013.01); *B65H 49/10* (2013.01);
(Continued)

(58) Field of Classification Search
CPC ..... B65H 49/16; B65H 49/14; B65H 49/36; B65H 49/02; B65H 49/04; B65H 49/06; B65H 49/10; B65H 49/12; B65H 49/18; B65H 49/20; B65H 49/26; B65H 49/32; B65H 49/38; B65H 2701/31; D02H 1/00
See application file for complete search history.

(56) References Cited

U.S. PATENT DOCUMENTS 1,608,863 A * 11/1926 Roe ..... B65H 49/26 242/130
2,253,238 A * 8/1941 Jackson ..... B65H 49/06 242/130
(Continued)

FOREIGN PATENT DOCUMENTS

CN 101348199 A 1/2009
DE 1485322 A1 6/1969
(Continued)

OTHER PUBLICATIONS

International Searching Authority, International Search Report and Written Opinion for International Application No. PCT/US2019/014967, dated Jul. 25, 2019, (14 pages), U.S.
(Continued)

*Primary Examiner* — Michael R Mansen
*Assistant Examiner* — Raveen J Dias
(74) *Attorney, Agent, or Firm* — Alston & Bird LLP

(57) ABSTRACT

A tube holder supports a spool of flexible line wrapped onto the outer surface of a tube. The tube holder comprises a body portion configured to support the tube thereon, such that the interior surface of the tube rests of the top surface of the body portion; and an end protector detachably secured to the distal end of the body portion via a quick-release, contact fastener. The end protector is configured to be detachably secured to the body portion, while remaining spaced away from the tube such that the tube does not interfere with connecting the end protector with the body portion.

20 Claims, 8 Drawing Sheets

(51) Int. Cl.

| | |
|---|---|
| ***D02H 1/00*** | (2006.01) |
| ***B65H 49/04*** | (2006.01) |
| ***B65H 49/14*** | (2006.01) |
| ***B65H 49/02*** | (2006.01) |
| ***B65H 49/10*** | (2006.01) |
| ***B65H 49/12*** | (2006.01) |
| ***B65H 67/06*** | (2006.01) |
| ***B65H 57/16*** | (2006.01) |

(52) U.S. Cl.
CPC ..... *B65H 49/14* (2013.01); *B65H 49/16* (2013.01); *B65H 57/16* (2013.01); *B65H 67/06* (2013.01); *D02H 1/00* (2013.01); *B65H 49/12* (2013.01); *B65H 2701/31* (2013.01)

(56) References Cited

U.S. PATENT DOCUMENTS

| | | | | | |
|---|---|---|---|---|---|
| 2,331,647 | A | * | 10/1943 | Barkstrom | B65H 49/36 403/332 |
| 2,366,101 | A | | 12/1944 | Grothey | |
| 2,497,267 | A | * | 2/1950 | McDermott | B65H 49/02 403/18 |
| 2,561,155 | A | | 7/1951 | Thomas, Jr. et al. | |
| 2,647,704 | A | | 8/1953 | Samler et al. | |
| 2,656,127 | A | * | 10/1953 | Bunch | B65H 54/543 242/597.4 |
| 2,704,643 | A | | 3/1955 | Lambach | |
| 2,869,802 | A | | 1/1959 | Williams | |
| 2,981,496 | A | * | 4/1961 | Harmon | B65H 49/36 242/129.8 |
| 3,122,113 | A | | 2/1964 | Edwards | |
| 3,493,192 | A | | 2/1970 | Hoard | |
| 4,063,697 | A | * | 12/1977 | Venot | B65H 59/06 242/131 |
| 4,552,321 | A | * | 11/1985 | Raeckelboom | B65H 49/04 242/130 |
| 4,634,077 | A | * | 1/1987 | Wilson | B65H 49/20 242/130 |
| 4,705,231 | A | | 11/1987 | Green | |
| 4,767,074 | A | | 8/1988 | Bower | |
| 5,203,518 | A | * | 4/1993 | Morgan | B65H 49/06 242/129.5 |
| 6,772,972 | B1 | | 8/2004 | Haselwander | |
| 7,438,253 | B2 | * | 10/2008 | Schunck | B65H 49/06 242/140 |
| 2007/0215742 | A1 | * | 9/2007 | Zollinger | D02H 1/00 242/558 |
| 2010/0090050 | A1 | * | 4/2010 | Vaughan | B65H 49/16 242/131 |
| 2012/0125245 | A1 | * | 5/2012 | Troncoso | B65H 57/18 112/302 |
| 2012/0211585 | A1 | * | 8/2012 | Kim | B65H 49/36 242/586 |
| 2018/0264572 | A1 | * | 9/2018 | Yamaguchi | B23H 7/10 |
| 2019/0031464 | A1 | * | 1/2019 | Feng | B65H 59/387 |

FOREIGN PATENT DOCUMENTS

| | | | |
|---|---|---|---|
| EP | 0438785 | A1 | 7/1991 |
| KR | 2010-0006691 | A | 1/2010 |

OTHER PUBLICATIONS

European Patent Office, Extended European Search Report for Application No. 18178322.6, dated Dec. 6, 2018, 9 pages, Germany.

* cited by examiner

TUBE HOLDER FOR LINE DISPENSING

BACKGROUND

Threads, strings, yarns, filaments and other flexible lines are often fed into textile manufacturing processes (e.g., carpet tufting processes, fabric manufacturing processes, and/or the like) from line spools wrapped around cardboard tubes. Those tubes may be reused in some manufacturing environments, with empty tubes being rewrapped with additional flexible lines after the tube has been emptied. Even in large, industrial textile manufacturing settings, those manufacturing processes require relatively consistent line tension settings leading into the manufacturing machinery to produce uniform, desirable textile products. However, the cardboard tubes themselves have historically been a source of problems impacting the tension in lines fed from the respective spools into the manufacturing machinery, because even small cuts or other imperfections in an end of a cardboard tube can catch the line as it is fed from the spool and create undesirable increases in the tension of the line leading into the machinery. Since the cardboard tubes may be reused multiple times prior to disposal, the cardboard tubes may be repeatedly damaged, crushed, torn, and/or the like after multiple uses. In some extreme cases, the line tension can increase beyond the tensile strength of the line itself, thereby causing the line to snap and to create substantial delays in the manufacturing process.

The historical approach to minimizing the detrimental impacts of damaged cardboard tubes has been to secure a rigid protecting end cap onto the cardboard tube itself. The cap includes generally smooth edges that cover the rough, damaged end of the cardboard tube, such that the line is able to slide smoothly over the surface of the end cap as it is fed into the processing machinery. However, the end caps are generally shaped to conform to the generally round-shape of cardboard tubes, and therefore they are often incapable of attaching relative to deformed (e.g., oblong, ovular, flat, and/or the like) tubes that may have been severely damaged or misshapen prior to use.

Accordingly, a need exists for tube holders capable of smoothly and consistently dispensing spooled line from damaged and/or misshapen cardboard tubes.

BRIEF SUMMARY

A tube holder configured to suspend a cardboard tube including a spool of flexible line resting on a top surface of the tube holder enables the tube holder to support cardboard tubes having a variety of cross-section shapes (including both round and out-of-round). Certain tube holder configurations may also comprise a detachable end protector that may be quickly and easily attached and detached from a distal end of the tube holder via a contact fastener mechanism (e.g., a magnet, electromagnet, hook-and-loop fasteners, detent mechanism, and/or the like). The end protector may minimize the likelihood of line drawn off of the spool coming in contact with a possibly damaged end of the cardboard tube, regardless of the overall shape of the supported cardboard tube.

Various embodiments are directed to a tube holder for supporting a tube while flexible line is drawn off of a spool of flexible line coiled onto the tube. In certain embodiments, the tube holder comprises: a body portion configured to support the tube thereon, wherein the body portion defines a base end and an opposite distal end and the distal end comprises a contact fastener member; and an end protector detachably secured to the distal end of the body portion, and wherein the end protector comprises a mating fastener member configured to be secured relative to the contact fastener member.

In various embodiments, the contact fastener member and the mating fastener member collectively comprise a magnet and a magnetic member. Moreover, the body portion and the end protector may each comprise a non-magnetic material. In certain embodiments, the end protector comprises a central hub at least substantially centered relative to the end protector and a rim surrounding the perimeter of the end protector; the mating fastener member is secured within the central hub of the end protector; and the rim defines an overhang portion configured to extend beyond the distal end of the body portion when the end protector is secured relative to the distal end of the body portion. Moreover, the end protector may be reversible, and the rim may define a first overhang portion on a first side of the end protector and a second overhang portion on a second side of the end protector, and wherein: the first overhang portion extends beyond the distal end of body portion by a first distance when the end protector is secured relative to the body portion in a first configuration; and the second overhang portion extends beyond the distal end of the body portion by a second distance when the end protector is secured relative to the body portion in a second configuration, wherein the second distance is greater than the first distance. In certain embodiments, the distal end of the body portion defines a retention tab configured to retain the tube on the body portion, and wherein: the first distance is less than or equal to a thickness of the retention tab, such that the first overhang portion does not extend over an end of the tube when the end protector is secured relative to the distal end of the body portion; and the second distance is greater than the thickness of the retention tab, such that the second overhang portion extends over the end of the tube when the end protector is secured relative to the distal end of the body portion.

Moreover, in various embodiments the body portion defines a hollow interior having an opening at the base end of the body portion, and wherein the body portion is configured to be secured relative to a creel peg extending into the interior of the body portion. The base end of the body portion may define a placement ramp extending vertically upward away from a top surface of the body portion and having a curved transition between the placement ramp and the top surface of the body portion, wherein the placement ramp may be configured to bias a supported tube toward the distal end of the body portion. The distal end of the body portion may further define a retention tab configured to retain the tube on the body portion. Moreover, the end protector may comprise a rigid material. In certain embodiments, the body portion further comprises a lower fin extending along a lower surface of the body portion and away from the distal end of the body portion, wherein the lower fin is configured to impede flexible line catching on the bottom surface of the body portion.

Various embodiments are directed to a creel for dispensing flexible line from a plurality of line spools each wrapped around a corresponding tube. The creel may comprise a plurality of tube holders each secured to a corresponding creel peg of the creel, each of the plurality of tube holders comprising: a body portion configured to support a tube thereon, wherein the body portion defines a base end, an opposite distal end, and a hollow interior having an opening within the base end, and wherein a corresponding creel peg extends into the hollow interior of the body portion and the distal end comprises a contact fastener member; and an end protector detachably secured to the distal end of the body portion, and wherein the end protector comprises a mating fastener member configured to be secured relative to the contact fastener member.

In various embodiments, the plurality of tube holders are at least substantially parallel to one another and are arranged in at least substantially vertical columns within the creel. Moreover, the body portion of each of the plurality of tube holders may further comprise a lower fin extending along a lower surface of the body portion and away from the distal end of the body portion, wherein the lower fin is configured to impede flexible line draped from an upper tube holder from becoming caught around a bottom portion of a lower tube holder. In certain embodiments, the contact fastener member and the mating fastener member collective comprise a magnet and magnetic member. Moreover, in certain embodiment the end protector comprises a central hub at least substantially centered relative to the end protector and a rim surrounding the perimeter of the end protector; the mating fastener member is secured within the central hub of the end protector; and the rim defines an overhang portion configured to extend beyond the distal end of the body portion when the end protector is secured relative to the distal end of the body portion. Moreover, the end protector is reversible, and the rim defines a first overhang portion on a first side of the end protector and a second overhang portion on a second side of the end protector, and wherein: the first overhang portion extends beyond the distal end of body portion by a first distance when the end protector is secured relative to the body portion in a first configuration; and the second overhang portion extends beyond the distal end of the body portion by a second distance when the end protector is secured relative to the body portion in a second configuration, wherein the second distance is greater than the first distance.

In certain embodiments, the distal end of the body portion defines a retention tab configured to retain the tube on the body portion, and wherein: the first distance is less than or equal to a thickness of the retention tab, such that the first overhang portion does not extend over an end of the tube when the end protector is secured relative to the distal end of the body portion; and the second distance is greater than the thickness of the retention tab, such that the second overhang portion extends over the end of the tube when the end protector is secured relative to the distal end of the body portion. Moreover, the base end of the body portion may define a placement ramp extending vertically upward away from a top surface of the body portion and having a curved transition between the placement ramp and the top surface of the body portion, wherein the placement ramp is configured to bias a supported tube toward the distal end of the body portion. The distal end of the body portion may further define a retention tab configured to retain the tube on the body portion.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
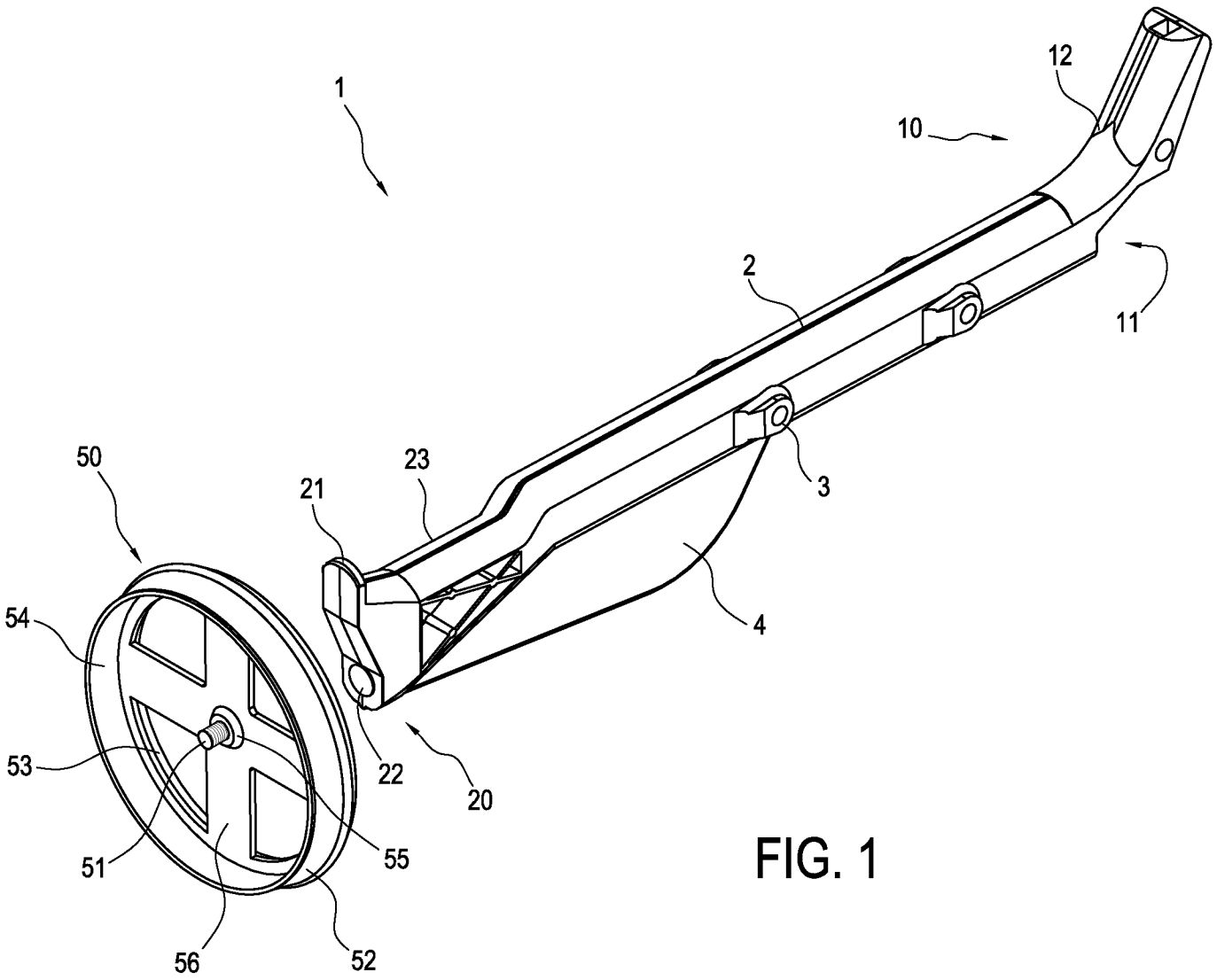
FIG. 1 shows a perspective view of a tube holder according to one embodiment.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

Overview

Creels configured for dispensing flexible line (e.g., a thread, a string, a yarn, a filament and/or the like) from a plurality of cardboard tubes may comprise a plurality of tube holders each configured to support a single cardboard tube while line is unspooled and pulled off of the installed cardboard tube. Generally, the tube holders are configured such that the installed cardboard tubes remain at least substantially stationary (e.g., without rotating) on the respective tube holders, and the flexible line is unspooled by a tensile force pulling the flexible line across an end of the cardboard tube and tube holder.

Each tube holder comprises an elongated body on which an interior surface of the cardboard tube is supported. The elongated body has a cross-sectional shape and size configured such that cardboard tubes may easily slide onto the elongated body, even when those cardboard tubes are damaged and/or misshapen (e.g., out-of-round, such as ovular or flat). The elongated body portion is configured to be secured onto a creel peg of the creel, via a hollow portion of the elongated body enabling the elongated body to be slid onto the creel peg to secure the tube holder thereon. Moreover, the elongated body defines a base end (proximate the creel peg opening) and an opposite distal end onto which the cardboard tubes are slid. In certain embodiments, the base end defines a gradually sloped placement ramp extending vertically upward away from the elongated body and configured to bias an installed cardboard tube toward the distal end under the force of gravity, as the cardboard tube slides down the gradually sloped placement ramp and toward the distal end. The distal end prevents the cardboard tube from sliding off of the tube holder with a retention tab extending vertically upward away from the elongated body. Thus, cardboard tubes may be quickly slid onto the tube holder such that the cardboard tube slides partially up the placement ramp, once placed on the tube holder, the cardboard tube then slides back toward the distal end until it contacts the retention tab.

The tube holders further comprise a removable end protector configured to protect the flexible line from snagging on a damaged end of the cardboard tube. The removable end protector is secured relative to the distal end of the elongated body via a contact fastening mechanism (e.g., a fastening mechanism whereby an act of contacting one part relative to another, in some circumstances with mild compressive force, causes the parts to be secured relative to one another). For example, the removable end protector may be magnetically secured relative to the elongated body. As a specific example, the distal end of the elongated body may comprise a magnet therein, and the end protector may comprise a magnetic member therein, such that contacting the magnetic member of the end protector with the magnet of the elongated body causes the end protector to be secured relative to the elongated body.

The removable end protector may define an at least substantially circular member having a smooth rim extending around the perimeter of the end protector. The smooth rim may have an overhanging ledge configured to extend over a portion of the elongated body (and therefore over the end of an installed cardboard tube) to separate the flexible line from the potentially damaged edge of the cardboard tube. The removable end protector may be reversible, and each side may have a different overhang length. For example, a first side may have an overhang length configured to extend beyond an end of a cardboard tube installed on the tube holder, and the second side may have a smaller overhang length that does not extend beyond an interior surface of the retention tab, such that the end protector does not interfere with the placement of an out-of-round cardboard tube on the tube holder.

Tube Holder

FIG. 1 is a perspective view of a tube holder 1 according to one embodiment. In the illustrated embodiment, the tube holder 1 comprises a rigid material, such as a plastic, a wood, a metal, and/or the like. As just one non-limiting example, the tube holder 1 may comprise a glass fiber infused nylon that is not subject to environmental condition-dependent size fluctuations (e.g., shrinkage during low temperature periods and/or expansion during high temperature periods).

The tube holder 1 shown in FIG. 1 defines an elongated, narrow body portion 2, extending between a base end 10 and a distal end 20. The body portion 2 has a rounded top surface configured to self-center rounded tubes placed thereon (described in greater detail herein). Both the width and height of the narrow body portion 2 is substantially smaller than the diameter of a cardboard tube placed onto the tube holder 1, such that the cardboard tube slides easily onto the tube holder 1 without resistance. The narrow shape of the body portion 2 enables misshapen (out-of-round) cardboard tubes to be placed onto the tube holder 1, as described herein.

Figure 2:
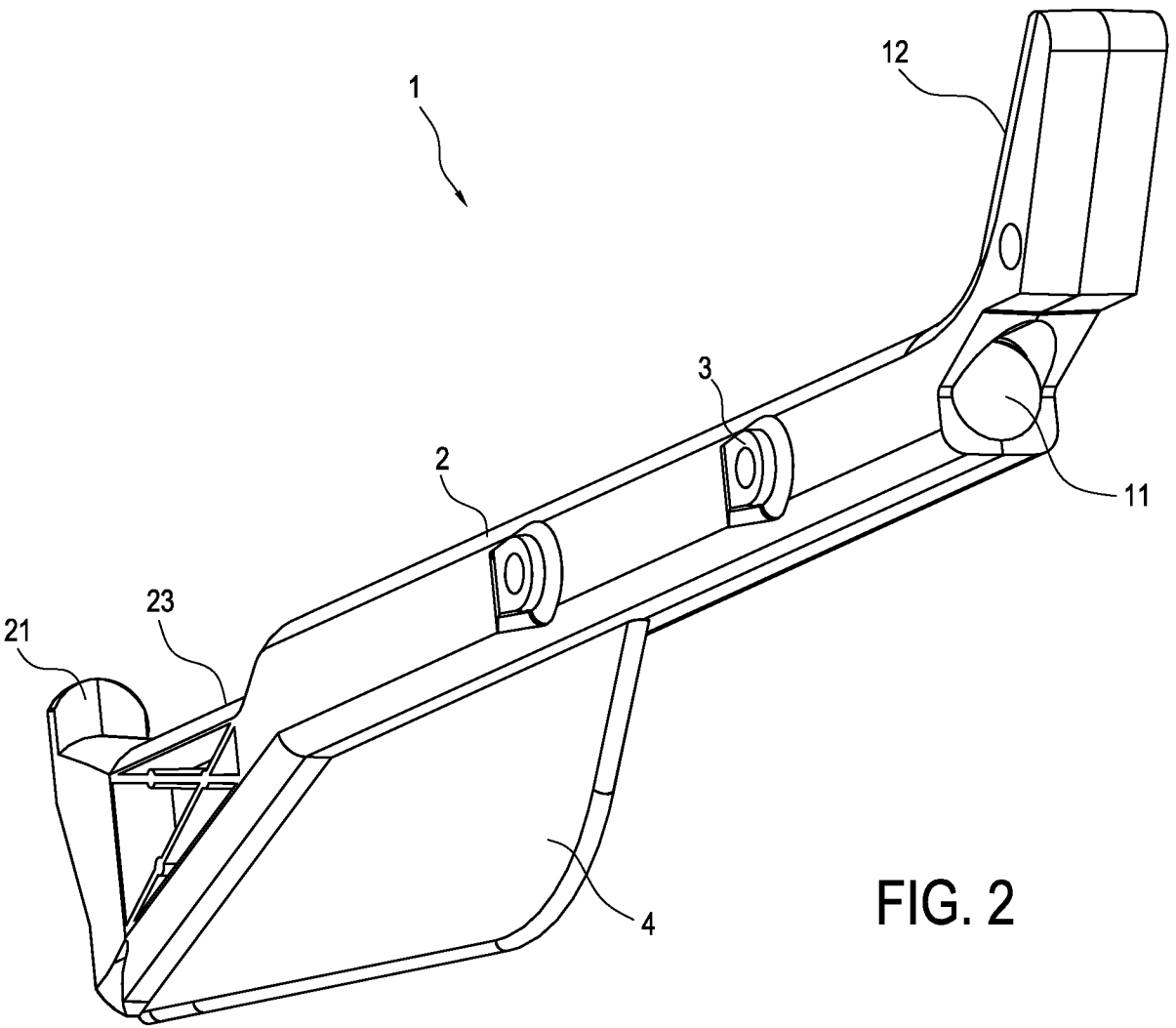
FIG. 2 shows a rear perspective view of the tube holder shown in FIG. 1.
Figure 8:
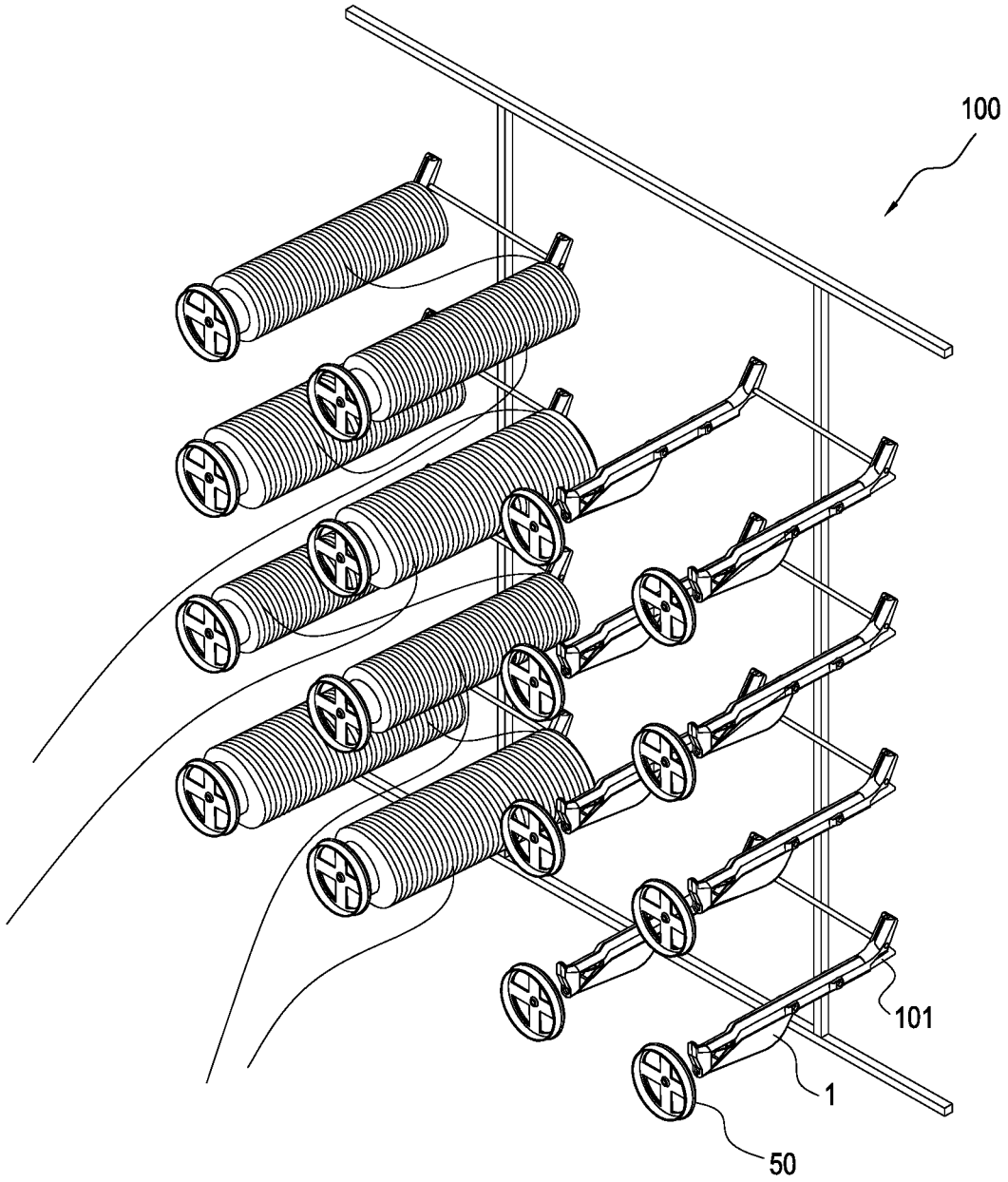
FIG. 8 shows a creel having a plurality of tube holders according to one embodiment.

The body portion 2 defines a hollow interior extending from an opening 11 at the base end 10 of the tube holder 1, as shown in the rear-perspective view of FIG. 2. The opening 11 and hollow interior are configured to accept at least a portion of a creel peg 101 to secure the tube holder 1 within a creel 100 (as shown in FIG. 8). For example, the opening 11 and hollow interior may have an at least substantially circular cross-section to accept a circular creel peg 101 therein. However, it should be understood that any of a variety of cross-sectional shapes may be utilized to conform to corresponding creel peg 101 configurations. For example, the hollow interior may have square, rectangular, triangular, ovular, and/or other shaped cross-sections.

Moreover, the body portion 2 may define one or more creel-fastener configurations, such as set-screw holes 3 shown in FIG. 1. For example, the set-screw holes 3 may be formed within thickened sidewall portions of the body portion 2 which provide additional material for a set-screw to be secured within the body portion 2. The set-screw holes 3 extend through the sidewalls of the body portion 2 to intersect the hollow interior of the body portion 2, such that set screws may be secured within the corresponding set screw holes 3 to engage a surface of a creel peg 101 positioned within the hollow interior of the body portion 2. Certain embodiments may comprise alternative creel-fastener configurations, such as a detent mechanism for securing the creel peg 101 (which may have a corresponding detent groove/ring) to secure the creel peg 101 within the hollow interior of the body portion. Other example creel-fastener configurations may be adhesives, through-bolts, and/or the like that may be used to secure the creel peg 101 within the hollow interior of the body portion 2. Moreover, as shown in the example embodiment of FIG. 1, the thickened sidewall portions corresponding to the set screw holes 3 may be surrounded by chamfered edges to prevent flexible line (for example, dangling from a cardboard tube on an adjacent tube holder 1) from undesirably catching on the edges of the thickened sidewall portions. Additionally, the thickened sidewall portions may be provided such that a single, elongated thickened sidewall portion may correspond to a plurality of set screw holes 3, or each individual set screw hole 3 may correspond to a single thickened sidewall portion.

The base end 10 of the body portion 2 shown in FIG. 1 defines a gradually sloped placement ramp 12 defining a curved transition between the generally horizontal portion of the body portion 2 (along an elongated axis of the body portion 2) to an angled portion of the placement ramp 12. The gradually sloped placement ramp 12 facilitates loading of spools of flexible line onto the body portion 2. In practice, full spools of flexible line may weigh greater than 10 lbs., and personnel may be required to hoist those relatively heavy spools of line to load tube holders 1 at various heights ranging from a few inches above the ground (requiring personnel to bend over and place the spools onto the body portion 2) to heights greater than 6 ft above the ground (requiring personnel to hoist spools above their head to place those spools onto the body portion 2). The gradually sloped placement ramp 12 enables loading personnel to quickly slide the spools of line onto the body portion 2 with little required precision, and the gradually sloped placement ramp 12 ensures the spools slide into a desired position for feeding line into a processing mechanism.

The placement ramp 12 and the horizontal top surface of the body portion 2 define an obtuse angle therebetween. For example, the angle between the placement ramp 12 and the horizontal top surface of the body portion 2 may be between about 90 degrees and 135 degrees (e.g., between about 115-135 degrees) such that a cardboard tube slid onto the body portion 2 such that an end of the cardboard tube slides up the curved transition and onto the placement ramp 12 will be biased under the force of gravity to slide back down the placement ramp 12 such that the opposite, distal end of the cardboard tube is biased toward the distal end 20 of the base portion 2. Moreover, the curved transition between the horizontal portion of the body portion and the placement ramp 12 enables a cardboard tube to be smoothly slid onto the body portion 2, along the horizontal portion of the body portion 2 and up the placement ramp 12 without requiring a manual redirection of the cardboard tube to begin sliding up the placement ramp 12. Moreover, as shown in FIG. 1, the placement ramp 12, like the remainder of the body portion 2 may define a generally curved sliding surface that curves toward the sidewalls of the body portion 2 to accommodate cardboard tubes of various shapes (and various degrees of damage causing the tube to be out-of-round).

Figure 3A:
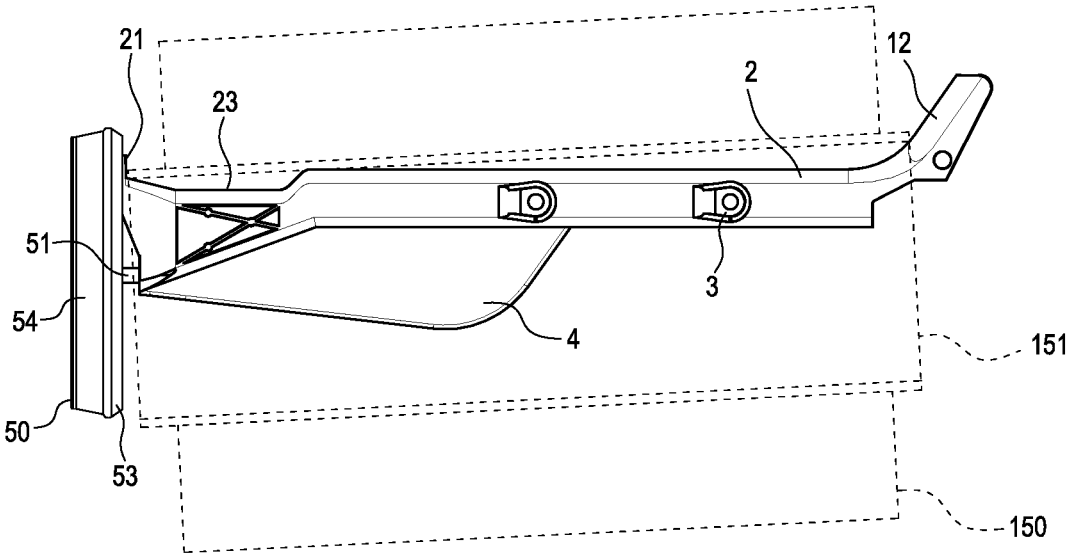
FIGS. 3A-3B show side views of the tube holder shown in FIG. 1 in various configurations.
Figure 3B:
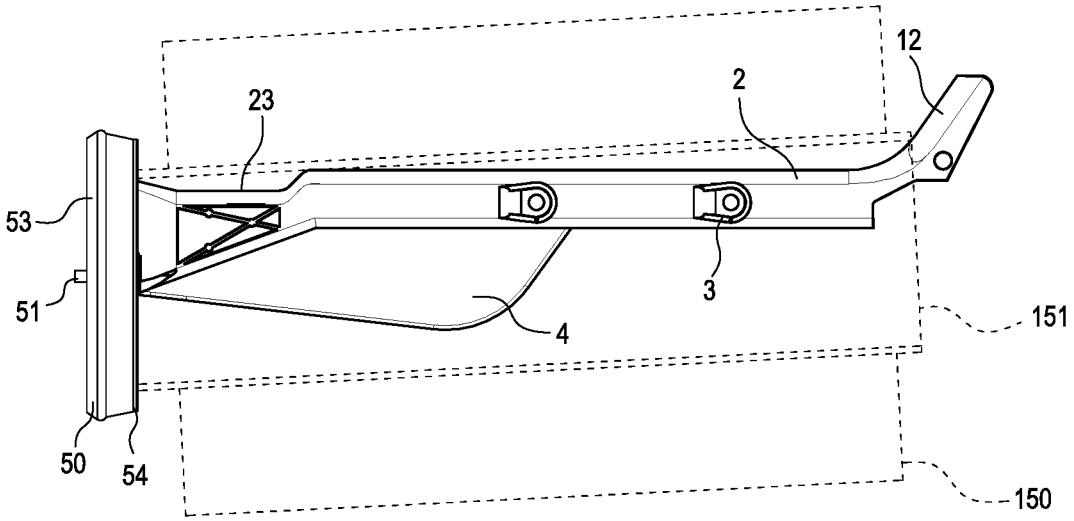
Figure 4:
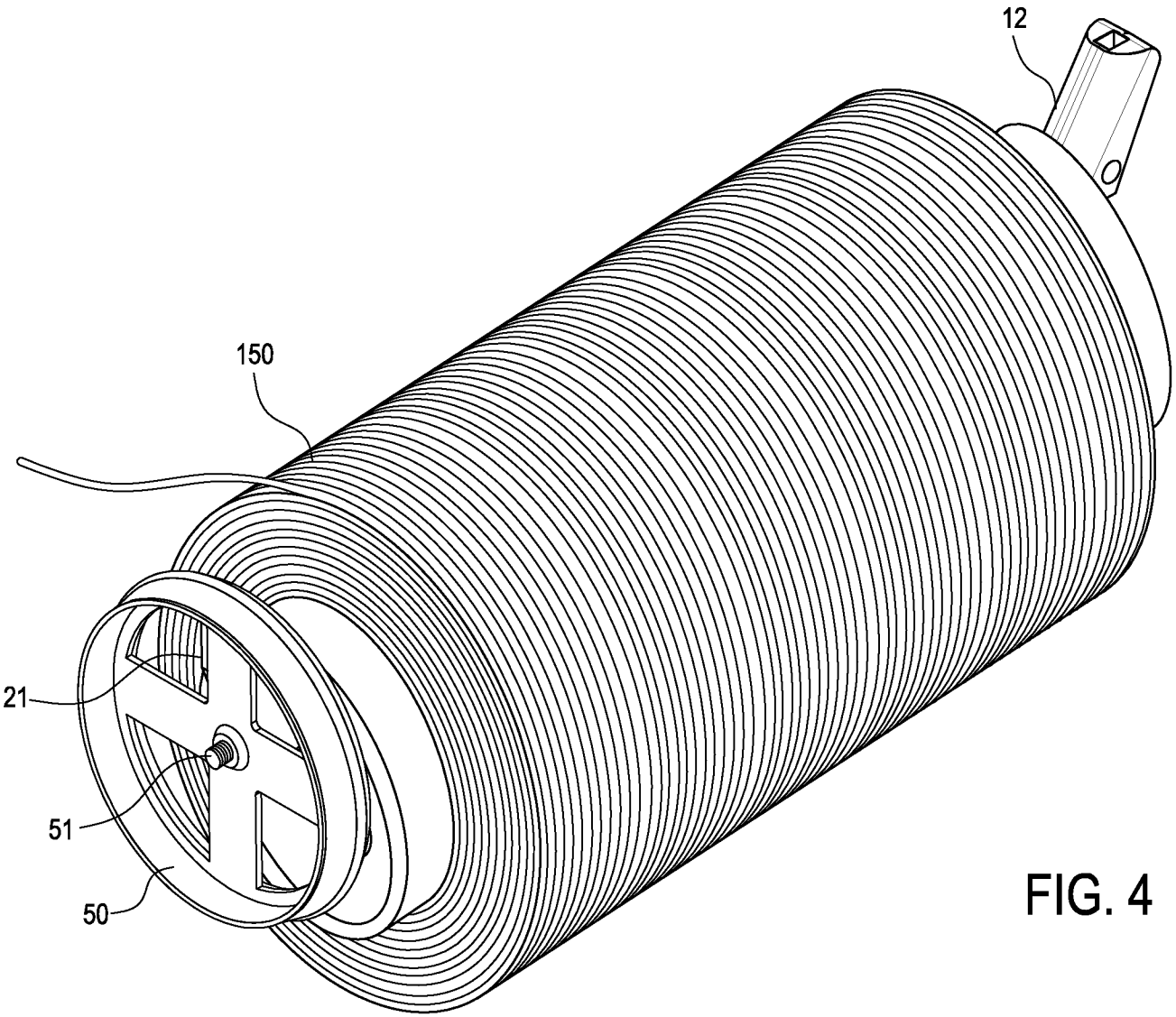
FIG. 4 shows a perspective view of an out-of-round tube hung on a tube holder according to one embodiment.

The distal end 20 of the body portion 2 defines at least one retention tab 21 configured to prevent a cardboard tube from sliding off of the body portion 2 (for example, as it slides down the placement ramp 12). The retention tab 21 extends vertically upward from a top surface of the body portion 2 by a distance sufficient to extend above a surface of a cardboard tube supported on the body portion 2. FIG. 4 illustrates a cardboard tube 151 supporting a spool of line 150 placed onto the body portion 2 such that a first end of the cardboard tube is extended partially up the placement ramp 12, and the opposite end of the cardboard tube 151 is supported against the retention tab 21 of the distal end 20 of the body portion 2. Moreover, as shown in FIGS. 1-5, the distal end of the body portion 2 may define an indented top portion 23 adjacent the retention tab 21. The indented top portion 23 may be configured such that, as show in FIG. 5, a distal end of a cardboard tube 151 is not in contact with the top surface of the body portion 2 as the cardboard tube 151 is pushed onto the body portion 2 (and up the placement ramp 12). The indented top portion 23 ensures that potentially damaged end portions of the cardboard tube 151 do not impede the sliding movement of the cardboard tube 151 down the placement ramp 12 and into a desired position, which could result from a damaged portion of the end of the cardboard tube 151 catching on a top surface of the body portion 2. The potentially-damaged end portions of the cardboard tube 151 remain spaced a distance above/away from the top surface of the intended top portion 23 while the cardboard tube 151 slides down placement ramp 12, such that holding forces (e.g., frictional forces) that could otherwise form between the distal end of the cardboard tube and the surface of the body portion 2 do not prevent the cardboard tube 151 from sliding into contact with the retention tab 21.

As shown in FIG. 1, the distal end 20 of the body portion 2 may additionally comprise a contact fastener portion configured to secure a mating contact fastener portion of a removable end protector 50 relative to the body portion 2 of the tube holder 1. In the illustrated embodiment, the contact fastener mechanism comprises a quick release fastener, such as a magnet 22 (e.g., a rare earth magnet, such as a neodymium magnet) embedded within the distal end 20 of the body portion 2, and that magnet 22 being configured to secure the end protector 50 relative to the body portion 2 when a magnetic (e.g., ferrous metal; a magnet, and/or the like) member 51 contacts the magnet 22. As yet another example, the contact fastener mechanism may comprise a magnetic member (e.g., a ferrous metal) configured to engage a separate magnet (e.g., secured relative to an end protector 50). Other contact fastener mechanisms may be usable to secure the removable end protector 50 relative to body portion 2 by contacting (or by providing a slight compressive force) a first contact fastener portion relative to a second, mating contact fastener portion. Such contact fastener mechanisms are configured to enable quick attachment and/or removal of the end protector 50 from the body portion 2. Moreover, certain contact fastening mechanisms are rotatable fastening mechanisms enabling free rotation of the end protector 50 relative to the body portion 2 without decoupling (either fully or partially) the end protector 50 from the body portion 2. Such embodiments may prevent portions of flexible line from catching on imperfections in the rim of the end protector 50 (e.g., cuts, dents, and/or the like that may form from drops onto a rough surface during handling) by enabling the end protector 50 to rotate freely upon application of a rotational force (e.g., resulting from the flexible line catching on an imperfection in the surface of the rim). However, certain contact fastening mechanisms may be angularly fixed, such that the end protector 50 is not rotatable relative to the body portion 2.

In certain embodiments, the contact fastener portion of the body portion 2 may be positioned behind the front surface of the distal end 20 of the body portion 2, such that at least a portion of the contact fastener portion is within a groove, blind hole, and/or the like within the distal end 20 of the body portion 2. In such embodiments, the mating contact fastener portion of the end protector 50 may be positioned a distance away from a surface of the end protector 50 (e.g., on an end of a peg, rod, and/or the like extending away from the end protector 50) such that the mating contact fastener portion may be nested within the groove, blind hole, and/or the like of the distal end 20 of the body portion 2 to engage the contact fastener mechanism. Other non-limiting examples of contact fastener mechanisms may comprise electromagnets, hook-and-loop fasteners, suction cups, a tacky substance (e.g., a tacky polymer, such as a polystyrene), a detent mechanism (e.g., a spring-activated detent mechanism), a solenoid-actuated latching mechanism, and/or the like, or combinations thereof.

In embodiments in which the contact fastener mechanism comprises a magnet 22, the body portion 2 and the end protector 50 may comprise a non-magnetic material (e.g., a rigid plastic material) to ensure proper placement of the contact fastener portions relative to one another when the end protector 50 is secured relative to the body portion 2.

As shown in FIG. 1, the contact fastener portion of the body portion 2 is offset below the top surface of the body portion 2. The distance between the centerpoint of the contact fastener portion and the top surface of the body portion 2 may be provided such that the centerpoint of the contact fastener portion is at least substantially aligned with a central axis of a cardboard tube 151 supported on the tube holder 1. Thus, the distance between the top surface of the body portion 2 and the centerpoint of the contact fastener portion may be provided based on an expected diameter of cardboard tubes 151 utilized with the tube holder 1.

Moreover, as shown in FIG. 1, the contact fastener portion is offset behind the retention tab 21 of the distal end 20 of the body portion 2. The positioning of the contact fastener portion enables a smooth edge of the removable end protector 50 to overhang beyond the distal end 20 of the body portion 2 (and the retention tab 21) when the end protector 50 is secured onto the body portion 2.

In certain embodiments, the body portion 2 comprises a lower fin 4 extending along a portion of the length of the body portion 2. The lower fin 4 has a width substantially smaller than the width of the body portion 2, and the lower fin 4 is aligned with a central plane of the body portion 2. The lower fin 4 extends back away from a lowermost point of a distal end 20 of the body portion 2, and along a portion of a length of the body portion 2. In the illustrated embodiment of FIG. 1, the lowermost edge of the lower fin 4 defines an upward slope (e.g., linear slope) toward the distal end 20 of the body portion 2, and a rear-most edge defines a downward slope (linear) from the bottom surface of the body portion 2 to the lowermost edge of the lower fin 4. As shown in the illustrated embodiment of FIG. 1, the lower fin 4 transitions between the rear edge and the lowermost edge via a curved transition region. When the tube holder 1 is installed in a creel 100 comprising a plurality of tube holders 1 arranged in a grid-like orientation (as shown in FIG. 8), the lower fin 4 is configured to prevent a slack flexible line from a cardboard tube installed on an upper tube holder 1 from undesirable snagging portions of an empty tube holder 1 located below the cardboard tube. In the event the flexible line becomes looped around the empty tube holder 1, the line slides along the edge of the lower fin 4 as the tension in the line increases and frees itself from the empty tube holder 1.

With reference again to FIG. 1, the removable end protector 50 is shown separated from the body portion 2 in a first orientation. The removable end protector 50 may comprise a rigid material (e.g., a glass fiber reinforced nylon), and in certain embodiments, the removable end protector 50 comprises the same material as the body portion 2.

Figure 6:
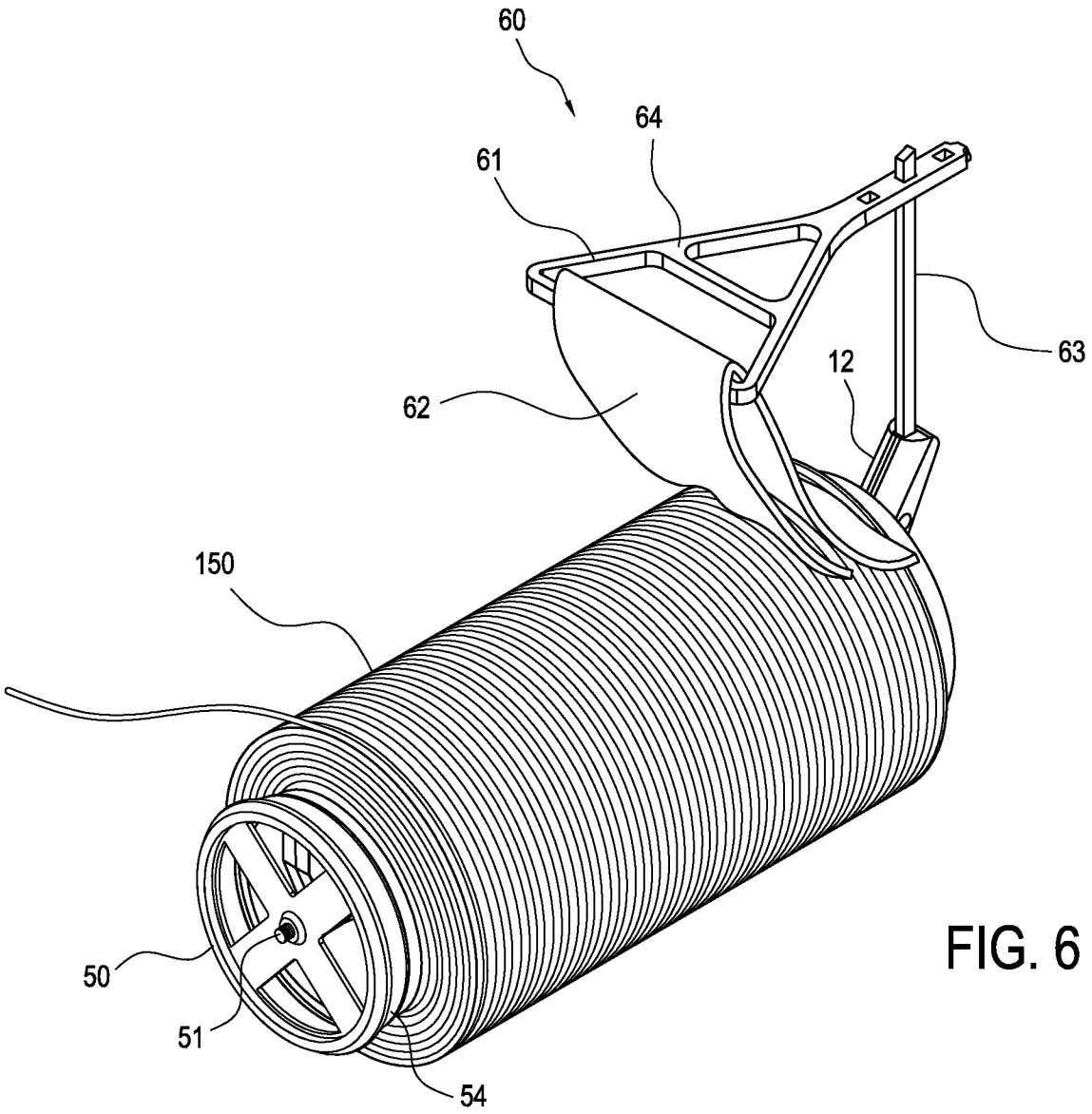
FIG. 6 shows a tube holder supporting a spool according to one embodiment.

The removable end protector 50 defines an at least substantially circular rim 52 surrounding a central hub portion 55. In certain embodiments, the rim 52 may be secured relative to the central hub portion 55 via a plurality of spokes 56. However, it should be understood that the plurality of spokes 56 may be replaced with a solid panel, a single spoke, and/or the like. As shown in FIGS. 4 and 6, which illustrate a typical round cardboard tube 151 held by a body portion 2, the plurality of spokes 56 may be sized such that the circular rim 52 does not contact any portion of the cardboard tube 151. Thus, the diameter of the circular rim 52 may be sized to accommodate an expected cardboard tube 151 to be utilized with the tube holder 1, such that a cardboard tube 151 in a round, non-deformed configuration, fits within the diameter of the circular rim 52 of the end protector 50 when secured relative to the body portion 2. Moreover, as discussed herein, the end protector 50 may be configured to accommodate out-of-round cardboard tubes 151 having a major diameter greater than the diameter of the end protector 50 as well by providing an connection orientation of the end protector 50 relative to the body portion 2 such that the end protector 50 does not overlap any portion of the out-of-round cardboard tube 151, such that the end protector 50 remains spaced a distance away from the cardboard tube 151 (as shown in FIG. 3A). Thus, the cardboard tube 151 does not interfere with the placement of the end protector 50 relative to the body portion 2.

The central hub portion 55 of the end protector 50 shown in FIG. 1 comprises the contact fastener portion configured to mate with the corresponding contact fastener portion of the body portion 2. For example, the illustrated end protector 50 comprises a magnetic member 51 (e.g., a ferrous metal pin including, for example, a machine screw) extending away from a face surface of the end protector 50 defined by the surfaces of the plurality of spokes 56. In the illustrated embodiment, the contact fastener portion axially extends away from opposing face surfaces (on opposite sides of the plurality of spokes 56) by an at least substantially equal distance such that the spokes 56 are positioned a defined distance away from the distal end 20 of the body portion 2 when the end protector 50 is secured relative to the body portion 2. The contact fastener portion of the end protector 50 may be configured such that the spokes 56 do not contact a portion of the body portion 2

Moreover, in certain embodiments the end protector 50 is free to rotate relative to the body portion 2 when secured relative to the contact fastener portion. However, in certain embodiments, the positioning of the end protector 50 may be rotationally fixed relative to the body portion 2.

In certain embodiments, the end protector 50 is reversible relative to the body portion 2, such that the end protector 50 may be secured in a first orientation relative to the body portion 2 (with a first side of the spokes 56 positioned adjacent the distal end of the body portion 2) or a second orientation relative to the body portion 2 (with a second side of the spokes 56, opposite the first side, positioned adjacent the distal end of the body portion 2).

The rim 52 of the illustrated embodiment defines two opposing sides, each extending away from the spokes 56. A first rim side 53 axially extends away from the spokes 56 by a first distance, and a second, opposite rim side 54 axially extends away from the spokes 56 by a second distance that is greater than the first distance. Thus, by changing the orientation of the end protector 50 relative to the body portion 2, the distance by which the rim 52 overhangs the distal end 20 of the body portion 2 may be changed, while the distance between the distal end of the body portion 2 and the spokes 56 may remain at least substantially equal). In a first orientation (as illustrated in FIG. 3A), the first rim side 53 extends only over only a portion of the retention tab 21 of the distal end 20 of the body portion 2. This configuration accommodates out-of-round, misshapen cardboard tubes (e.g., having an ovular shape) that may have a major diameter greater than the diameter of the round end protector 50, since the rim 52 does not extend axially over any portion of the cardboard tube itself resting against the retention tab 21, and thereby the end protector 50 remains spaced a distance away from the cardboard tube 151. This configuration still minimizes the potential for contact between the flexible line drawn off of the surface of the spool 150 and a damaged end portion of the cardboard tube 151. For example, as line is drawn off of the top portion of the spool 150, the line contacts the rim 52 of the end protector 50 rather than contacting the damaged end portion of the spool 150. While the line is drawn off of the sides or bottom of the spool 150, the flexible line falls away from the surface of the spool 150, the surface of the cardboard tube 151, and the surface of the end protector rim 52 under the force of gravity, such that the line is less likely to contact damaged end portions of the cardboard tube 151, even if the cardboard tube extends beyond the bottom edge of the end protector rim 52.

Moreover, the outer surface of the end protector rim adjacent the first rim side 53 may be raised relative to the outer surface of the end protector rim adjacent the second rim side 54. Because the first rim side 53 is provided to accommodate damaged and/or out-of-round tubes 151, the raised surface of the rim 52 may provide a greater minimum distance between the flexible line being drawn off of the spool 150 (which may fall onto the outer surface of the rim 52) and potential damaged portions (e.g., cuts, tears, and/or the like) in the surface of the tube 151 to minimize the likelihood of the flexible line undesirably catching on the damaged portions of the tube 151 as it is drawn off of the spool 150.

In the second configuration (shown in FIG. 3B), the second rim side 54 extends beyond the retention tab 21, such that a portion of the rim 52 is positioned axially over a distal end of a cardboard tube resting against the retention tab 21. This configuration provides added protection against a flexible line snagging on damaged portions of the distal end of the cardboard tube as it is drawn off of the cardboard tube, because those damaged portions of the cardboard tube are at least partially covered by the rim 52. Such a configuration requires that the dimensions of the cardboard tube fit within the interior of the second rim side 54 however, and therefore the second configuration may be usable only with small-diameter cardboard tubes and/or cardboard tubes that remain at least substantially round. Moreover, as shown in FIG. 3B, the circular rim 52 of the end protector 50 may remain spaced a distance away from the cardboard tube 151, and as previously mentioned, the distal end of the cardboard tube 151 rests against a surface of the retention tab 21, such that the cardboard tube 151 is retained a distance away from the absolute distal end of the body portion 2. The cardboard tube 151 thus does not contact any portion of the end protector 50 during normal operation, and therefore does not interference with the contact connection between the end protector 50 and the distal end of the body portion 2.

Figure 7:
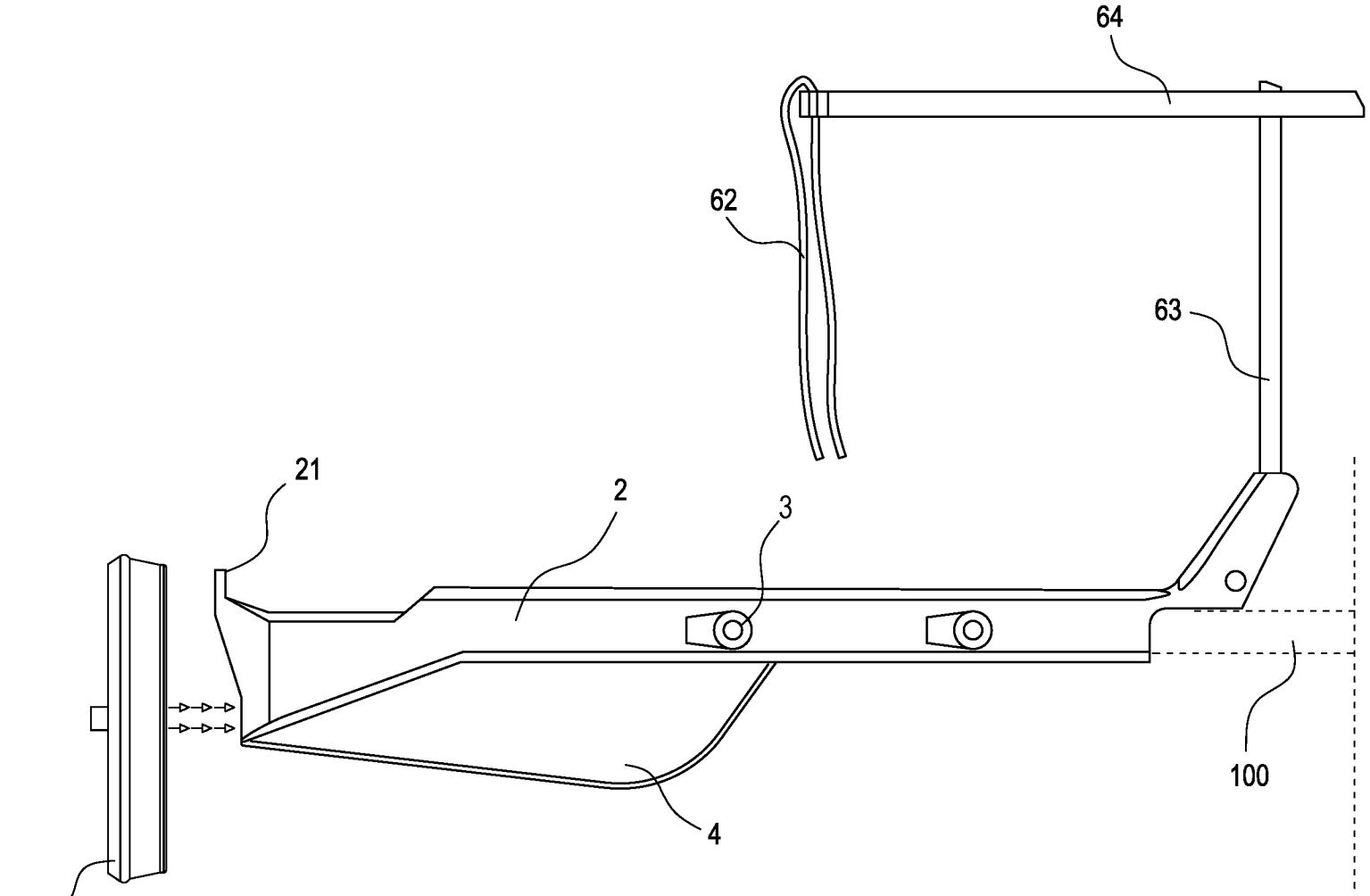
FIG. 7 shows a tube holder having a spool retainer according to one embodiment.

Moreover, as shown in FIGS. 6-7, the tube holder 1 may additionally comprise a spool retainer 60 configured to prevent a length of flexible line from falling behind a mass of flexible line spooled onto the cardboard tube 151. Because the spool 150 of flexible line has a non-negligible height extending off of an outer surface of a cardboard tube 151 (in certain embodiments a full spool of flexible line may have a thickness of several inches measured between the outermost surface of the spooled line and the surface of the cardboard tube 151), a slack length of flexible line may periodically fall behind the tightly wound mass of flexible line on the cardboard tube 151 and may get caught in this position (causing an undesirable increase in tension that may temporarily stop a production process using the flexible line). This problem is particularly acute during the short periods of time that the flexible line is unspooled from the back-most portion of the spool (proximate a back edge of the tightly wound spool 150), and a slight increase in line slack may enable the flexible line to fall off of the outermost surface of the spool and behind the back edge of the spool.

The spool retainer 60 as shown in FIGS. 6-7 provides a slight radial compressive force on a portion of the outer surface of the line spool 150 to ensure a temporary decrease in line slack does not enable the flexible line to fall behind the line spool 150. The spool retainer 60 comprises a hanger 61 for suspending a curtain 62 (e.g., comprising a flexible material such as a fabric sheet, a flexible membrane, a thread curtain, and/or the like) that drapes onto the outer surface of the spool. The weight of the draped curtain 62 on the spool maintains a minimum amount of tension on the flexible line as it is removed from the spool, which prevents the flexible line from falling behind the back edge of the spool.

As shown in FIG. 7, the hanger 61 is secured relative to the base end 10 of the body portion 2. For example, the hanger 61 may be detachably secured relative to the base end 10 of the body portion 2 (e.g., friction fit within a corresponding aperture within a top edge of the base end 10 of the body portion 2). The hanger 61 comprises a support leg 63 that supports a hanger frame 64 a distance above the top surface of the body portion 2, such that the curtain 62 drapes downward onto an upper portion of the spool 150. The hanger frame 64 extends at least substantially horizontally from the support leg 63 in a direction at least substantially parallel to the body portion 2. Moreover, the hanger frame 64 of the illustrated embodiment widens along its length (from a narrow portion proximate the support leg 63 to a wide portion at a distal end of the hanger frame 64). The wide portion of the hanger frame 64 may comprise one or more hanger rods extending across the width of the hanger frame 64, and those hanger rods may be configured to suspend the curtain 62 above the cardboard tube 151 and line spool 150.

In certain embodiments, the hanger 61 may comprise a single, integrally formed part comprising both the support leg 63 and hanger frame 64. However, in certain embodiments, the support leg 63 and hanger frame 64 may comprise separate parts that may be detachably secured relative to one another. Moreover, the orientation of the hanger frame 64 relative to the support leg 63 may be adjustable. For example, the hanger frame 64 may define a plurality of attachment points (e.g., attachment apertures) within the narrow portion of the hanger frame 64, such that the positioning of the hanger frame 64 may be moved forward and backward relative to the support leg 63. Moreover, the support leg 63 may define one or more support points along its length for supporting the hanger frame 64 at various heights above the body portion 2.

Moreover, the hanger 61 may comprise a flexible material (e.g., a flexible polypropylene homopolymer) configured to flex and elastically return to its original shape when subject to an external force. For example, the hanger 61 may be configured to flex when a line (e.g., from a separate tube holder 1) is caught behind a portion of the hanger 61, such that the line may free itself instead of breaking or becoming stuck behind the hanger 61.

Creel

FIG. 8 is a perspective view of a portion of a creel 100 comprising a plurality of tube holders 1 as described herein. In the illustrated embodiment, the creel 100 comprises a supporting frame with a plurality of creel pegs 101 extending at least substantially horizontally outward from vertical frame members of the creel 100. The creel pegs 101 are arranged in a plurality of vertically-aligned columns, such that connected tube holders 1 are generally vertically aligned relative to one another. Moreover, adjacent vertical frame members may be configured such that creel pegs 101 of the adjacent vertical frame members are generally horizontally aligned. In certain embodiments, two horizontally aligned creel pegs 101 (and the corresponding tube holders 1) feed a single line feed portion for a consuming machine (e.g., a carpet manufacturing system), and the consuming machine may utilize several individual line feed portions for production, each of those line feed portions being supplied by two corresponding creel pegs 101 and corresponding tube holders 1.

The tube holders 1 are secured onto respective creel pegs 101. The creel pegs 101 extend into the hollow interior of the respective tube holders 1, and fastening members (e.g., set screws) secure the tube holder 1 onto the outer surface of the respective creel pegs 101.

As discussed herein, the tube holders 1 may be configured to impede detrimental line-catches on adjacent tube holders 1 (e.g., when a line dangles from an upper tube holder 1 onto a lower tube holder 1).

Method of Use

Figure 5:
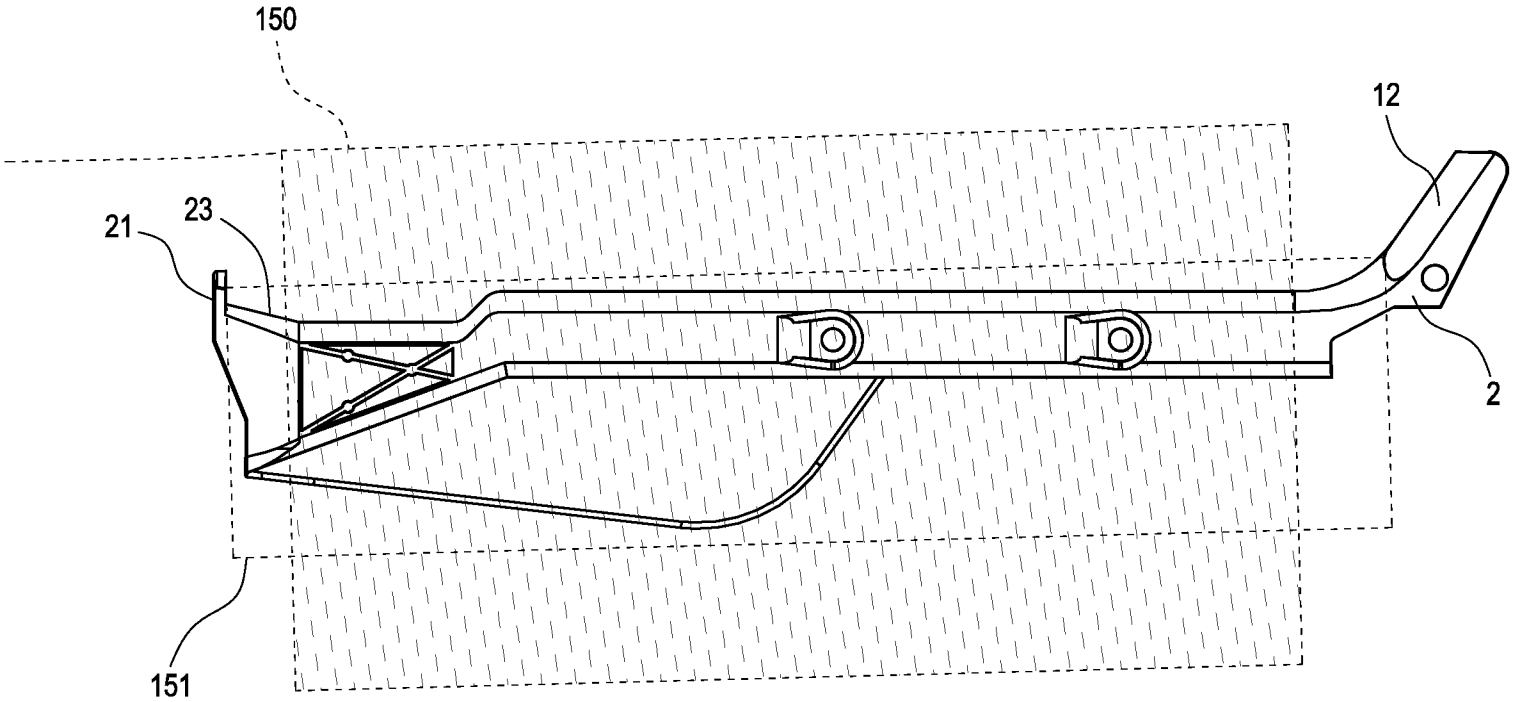
FIG. 5 shows a side schematic view of a tube holder supporting a cardboard tube and spool according to one embodiment.

To load a cardboard tube 151 onto a tube holder 1, the removable end protector 50 is pulled off of the distal end 20 of the body portion 2. The cardboard tube 151 is then slid onto the body portion 2 such that the body portion 2 is positioned within the interior of the cardboard tube 151 as shown in FIG. 5. The cardboard tube 151 is slid entirely onto the body portion 2, such that a first end of the cardboard tube 151 is slid at least partially up the placement ramp 12, and the opposite, second end of the cardboard tube 151 is slid entirely over the retaining tab 22, with the cardboard tube 151 resting on the top surface of the tube holder 1. The cardboard tube 151 is then released, allowing the cardboard tube 151 to slide down the placement ramp 12 until the second end of the cardboard tube 151 is in contact with the retaining tab 21. The removable end protector 50 is then replaced onto the distal end 20 of the body portion 2 by engaging the contact engagement member. The orientation of the removable end protector 50 may be chosen based at least in part on the shape of the cardboard tube 151. For an out-of-round cardboard tube 151 (e.g., an ovular cardboard tube) having a major diameter longer than the diameter of the end protector 50, the end protector 50 may be secured in the first orientation, such that the rim 52 does not extend beyond the retention tab 21 (thereby ensuring the end protector 50 may be secured without interference by the cardboard tube 151). For round, or nearly-round cardboard tubes 151 with a major diameter smaller than the diameter of the end protector 50, the end protector 50 may be secured in the second orientation, such that the rim 52 extends beyond the second end of the cardboard tube 151 to protect line drawn off of the spool 150 of the cardboard tube 151 from undesirably catching on damaged portions of the cardboard tube end. The line may then be threaded through machine-specific feed mechanisms, and the line may be drawn off of the spool as needed.

In embodiments comprising a spool retainer 60, the spool retainer 60 (including the curtain 62) may remain secured relative to the body portion 2 while the cardboard tube is being placed onto the tube holder 1. The line spool 150 may swing the curtain 62 toward the base end 10 of the body portion, and a portion of the curtain 62 may be draped onto the outer surface of the spool 150. The weight of the draped portion of the curtain 62 may thereafter prevent the line from undesirably falling behind the thick spool 150, thereby minimizing machine stops caused by portions of the line caught behind the spool 150.

CONCLUSION

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tube holder for supporting a tube while flexible line is drawn off of a spool of flexible line coiled onto the tube, wherein the tube holder comprises:

a body portion configured to support the tube thereon, wherein the body portion defines a base end and an opposite distal end and the distal end comprises a contact fastener member; and an end protector detachably secured to the distal end of the body portion, and wherein the end protector comprises a mating fastener member configured to be secured relative to the contact fastener member; and wherein the contact fastener member and the mating fastener member collectively comprise a magnet and a magnetic member.

2. The tube holder of claim 1, wherein the body portion and the end protector each comprise a non-magnetic material.

3. The tube holder of claim 1, wherein:

the end protector comprises a central hub at least substantially centered relative to the end protector and a rim surrounding a perimeter of the end protector;

the mating fastener member is secured within the central hub of the end protector; and the rim defines an overhang portion configured to extend beyond the distal end of the body portion when the end protector is secured relative to the distal end of the body portion.

4. The tube holder of claim 3, wherein the end protector is reversible, the overhang portion is a first overhang portion on a first side of the end protector and the rim additionally defines a second overhang portion on a second side of the end protector, and wherein:

the first overhang portion extends beyond the distal end of body portion by a first distance when the end protector is secured relative to the body portion in a first configuration; and the second overhang portion extends beyond the distal end of the body portion by a second distance when the end protector is secured relative to the body portion in a second configuration, wherein the second distance is greater than the first distance.

5. The tube holder of claim 1, wherein the body portion defines a hollow interior having an opening at the base end of the body portion, and wherein the body portion is configured to be secured relative to a creel peg extending into the hollow interior of the body portion.

6. The tube holder of claim 1, wherein the base end of the body portion defines a placement ramp extending vertically upward away from a top surface of the body portion and having a curved transition between the placement ramp and the top surface of the body portion, wherein the placement ramp is configured to bias a supported tube toward the distal end of the body portion.

7. The tube holder of claim 6, wherein the distal end of the body portion defines a retention tab configured to retain the tube on the body portion.

8. The tube holder of claim 1, wherein the end protector comprises a rigid material.

9. The tube holder of claim 1, wherein the body portion further comprises a lower fin extending along a lower surface of the body portion and away from the distal end of the body portion, wherein the lower fin is configured to impede flexible line catching on the lower surface of the body portion.

10. A tube holder for supporting a tube while flexible line is drawn off of a spool of flexible line coiled onto the tube, wherein the tube holder comprises:

a body portion configured to support the tube thereon, wherein the body portion defines a base end and an opposite distal end and wherein the distal end of the body portion defines a retention tab configured to retain the tube on the body portion, and the distal end comprises a contact fastener member; and a reversible end protector detachably secured to the distal end of the body portion, and wherein the end protector comprises:

a central hub at least substantially centered relative to the end protector;

a rim surrounding a perimeter of the end protector; and a mating fastener member secured within the central hub of the end protector, wherein the mating fastener member is configured to be secured relative to the contact fastener member; and wherein the rim defines:

a first overhang portion on a first side of the end protector, wherein the first overhang portion extends beyond the distal end of the body portion by a first distance when the end protector is secured relative to the body portion in a first configuration, and wherein the first distance is less than or equal to a thickness of the retention tab, such that the first overhang portion does not extend over an end of the tube when the end protector is secured relative to the distal end of the body portion; and a second overhang portion on a second side of the end protector, wherein the second overhang portion extends beyond the distal end of the body portion by a second distance when the end protector is secured relative to the body portion in a second configuration, wherein the second distance is greater than the first distance, and wherein the second distance is greater than the thickness of the retention tab, such that the second overhang portion extends over the end of the tube when the end protector is secured relative to the distal end of the body portion.

11. The tube holder of claim 10, wherein the contact fastener member and the mating fastener member collectively comprise a magnet and a magnetic member.

12. A creel for dispensing flexible line from a plurality of line spools each wrapped around a corresponding tube, the creel comprising:

a plurality of tube holders each secured to a corresponding creel peg of the creel, each of the plurality of tube holders comprising:

a body portion configured to support a tube thereon, wherein the body portion defines a base end, an opposite distal end, and a hollow interior having an opening within the base end, and wherein the corresponding creel peg extends into the hollow interior of the body portion and the distal end comprises a contact fastener member; and an end protector detachably secured to the distal end of the body portion, and wherein the end protector comprises a mating fastener member configured to be secured relative to the contact fastener member; and wherein the contact fastener member and the mating fastener member collectively comprise a magnet and a magnetic member.

13. The creel for dispensing flexible line of claim 12, wherein the plurality of tube holders are at least substantially parallel to one another and are arranged in at least substantially vertical columns within the creel.

14. The creel for dispensing flexible line of claim 13, wherein the body portion of each of the plurality of tube holders further comprises a lower fin extending along a lower surface of the body portion and away from the distal end of the body portion, wherein the lower fin is configured to impede flexible line draped from an upper tube holder from becoming caught around a bottom portion of a lower tube holder.

15. The creel for dispensing flexible line of claim 12, wherein:

the end protector comprises a central hub at least substantially centered relative to the end protector and a rim surrounding a perimeter of the end protector;

the mating fastener member is secured within the central hub of the end protector; and the rim defines an overhang portion configured to extend beyond the distal end of the body portion when the end protector is secured relative to the distal end of the body portion.

16. The creel for dispensing flexible line of claim 15, wherein the end protector is reversible, the overhang portion is a first overhang portion on a first side of the end protector and the rim additionally defines a second overhang portion on a second side of the end protector, and wherein:

the first overhang portion extends beyond the distal end of body portion by a first distance when the end protector is secured relative to the body portion in a first configuration; and the second overhang portion extends beyond the distal end of the body portion by a second distance when the end protector is secured relative to the body portion in a second configuration, wherein the second distance is greater than the first distance.

17. The creel for dispensing flexible line of claim 12, wherein the base end of the body portion defines a placement ramp extending vertically upward away from a top surface of the body portion and having a curved transition between the placement ramp and the top surface of the body portion, wherein the placement ramp is configured to bias a supported tube toward the distal end of the body portion.

18. The creel for dispensing flexible line of claim 17, wherein the distal end of the body portion defines a retention tab configured to retain the tube on the body portion.

19. A creel for dispensing flexible line from a plurality of line spools each wrapped around a corresponding tube, the creel comprising:

a plurality of tube holders each secured to a corresponding creel peg of the creel, each of the plurality of tube holders comprising:

a body portion configured to support a tube thereon, wherein the body portion defines a base end, an opposite distal end and wherein the distal end of the body portion defines a retention tab configured to retain the tube on the body portion, and a hollow interior having an opening within the base end, and wherein the corresponding creel peg extends into the hollow interior of the body portion and the distal end comprises a contact fastener member; and a reversible end protector detachably secured to the distal end of the body portion, wherein the end protector comprises:

a central hub at least substantially centered relative to the end protector;

a rim surrounding a perimeter of the end protector; and a mating fastener member configured to be secured relative to the contact fastener member; and wherein the rim defines:

a first overhang portion on a first side of the end protector, wherein the first overhang portion extends beyond the distal end of the body portion by a first distance when the end protector is secured relative to the body portion in a first configuration, and wherein the first distance is less than or equal to a thickness of the retention tab, such that the first overhang portion does not extend over an end of the tube when the end protector is secured relative to the distal end of the body portion; and a second overhang portion on a second side of the end protector, wherein the second overhang portion extends beyond the distal end of the body portion by a second distance when the end protector is secured relative to the body portion in a second configuration, wherein the second distance is greater than the first distance, and wherein the second distance is greater than the thickness of the retention tab, such that the second overhang portion extends over the end of the tube when the end protector is secured relative to the distal end of the body portion.

20. The creel for dispensing flexible line of claim 19, wherein the contact fastener member and the mating fastener member collectively comprise a magnet and a magnetic member.

* * * * *